US006945782B2

(12) United States Patent
Isoz et al.

(10) Patent No.: US 6,945,782 B2
(45) Date of Patent: Sep. 20, 2005

(54) METHOD AND ARRANGEMENT FOR INDICATING HITS

(75) Inventors: Peter Isoz, Huskvarna (SE); Micael Malmberg, Orlando, FL (US)

(73) Assignee: SAAB AB, Linköping (SE)

( * ) Notice: Subject to any disclaimer, the term of this patent is extended or adjusted under 35 U.S.C. 154(b) by 124 days.

(21) Appl. No.: 10/103,122

(22) Filed: Mar. 22, 2002

(65) Prior Publication Data

US 2005/0158694 A1 Jul. 21, 2005

(30) Foreign Application Priority Data

Mar. 30, 2001 (SE) ..... 0101167

(51) Int. Cl.[7] ..... F41A 33/00; F41G 3/26

(52) U.S. Cl. ..... 434/16; 434/11; 434/21; 434/22; 463/5

(58) Field of Search ..... 434/11, 14, 16, 434/19–23, 27, 365, 1, 2, 7, 51, 52; 463/5, 463/50–52; 446/175, 406, 473; 273/265, 273/371, DIG. 24

(56) References Cited

U.S. PATENT DOCUMENTS

| | | | | |
|---|---|---|---|---|
| 2,934,634 A | | 4/1960 | Hellberg | |
| 4,063,368 A | * | 12/1977 | McFarland et al. | 434/22 |
| 4,195,422 A | | 4/1980 | Budmiger | |
| 4,273,536 A | * | 6/1981 | Wick | 434/14 |
| 4,317,651 A | * | 3/1982 | Marshall et al. | 434/22 |
| 4,478,581 A | * | 10/1984 | Goda | 434/22 |
| 4,482,960 A | * | 11/1984 | Pryor | 701/28 |
| 4,561,849 A | * | 12/1985 | Eichweber | 434/22 |
| 4,695,058 A | * | 9/1987 | Carter et al. | 465/5 |
| 4,802,675 A | | 2/1989 | Wong et al. | |
| 4,854,595 A | * | 8/1989 | Eichweber | 463/5 |
| 4,898,391 A | | 2/1990 | Kelly et al. | |
| 5,417,573 A | * | 5/1995 | Cassiere et al. | 434/21 |
| 5,716,216 A | * | 2/1998 | O'Loughlin et al. | 434/22 |
| 5,788,500 A | * | 8/1998 | Gerber | 434/22 |
| 5,906,542 A | * | 5/1999 | Neumann | 463/52 |
| 5,988,645 A | * | 11/1999 | Downing | 273/348 |
| 6,071,166 A | * | 6/2000 | Lebensfeld et al. | 446/175 |
| 6,139,323 A | * | 10/2000 | Christians et al. | 434/16 |
| 6,386,879 B1 | * | 5/2002 | Varshneya et al. | 434/16 |
| 6,450,817 B1 | * | 9/2002 | Deinlein | 434/11 |
| 6,549,872 B2 | * | 4/2003 | Bollweg et al. | 702/158 |

FOREIGN PATENT DOCUMENTS

| | | | | |
|---|---|---|---|---|
| CH | 612004 | | 6/1979 | |
| DE | 3405017 A1 | * | 8/1985 | F41G 3/26 |
| JP | 02101399 A | * | 4/1990 | F41G 3/26 |

* cited by examiner

*Primary Examiner*—Joe H. Cheng
(74) *Attorney, Agent, or Firm*—Venable LLP; Eric J. Franklin

(57) ABSTRACT

The invention relates to a method and an arrangement for indicating that a target (1), such as a vehicle, has been hit. The target is provided with information on the weapon action, and a light source indicates a hit. The information can be made available by direct electromagnetic transmission, for example via radio, or by means of one or more strips (9–11) with detectors (13) being arranged on the target (1). In the latter case, the detectors detect incident illuminating electromagnetic radiation, and a light source indicates a hit when the incident radiation satisfies defined detection criteria. According to the invention, the light source is mounted directly in one or more strips (12) which in the present case can be the same as the detector strips and consist of distributed light points preferably in the form of light-emitting diodes (14). In this way, a protected and integrated solution is obtained which has little effect on the shape of the target.

22 Claims, 2 Drawing Sheets

METHOD AND ARRANGEMENT FOR INDICATING HITS

The present invention relates to a method for indicating hitting of a target such as a vehicle in the form of, for example, a tank, a track-mounted vehicle, a truck or other wheeled vehicle, the hit being indicated by means of a light source mounted on the target. The invention also relates to an arrangement for indicating hitting of a target such as a vehicle in the form of, for example, a tank, a track-mounted vehicle, a truck or other wheeled vehicle, said arrangement comprising a light source used for indicating hits and mounted on the target.

A number of examples of target types have been given above. However, there are many other possible types, and we do not exclude, for example, seagoing targets or target systems on soldiers.

For military field exercises, there are completely safe simulators which are used for tanks and other artillery weapons and which transmit hit codes to detectors which are mounted on each target. The detectors are often arranged in strips which are mounted horizontally on the tank turret, along the front of the tank, the sides and rear. A target which has been hit must indicate in an unambiguous manner that it has been taken out. In known methods and arrangements for indicating hits, the status of the target is marked by means of lights with rotating reflectors or by means of flashing lights. Such lights can function by flashing a few times if the hit does not result in the target being taken out, and by flashing continuously in the event of a hit which results in the target being taken out or when the crew does something which is not permitted and can be classed as cheating. In order to be seen, the lights are mounted on the roof of the tank turret.

The action of the weapon on the target can be transmitted in several different ways depending on which type of known simulator is chosen. For example, in accordance with the preceding paragraph, the target can be provided with one or more strips of detectors for detecting incident illuminating electromagnetic radiation, and, if said detected incident electromagnetic radiation satisfies defined detection criteria, this is indicated by means of the light source mounted on the target. Another alternative is, in conjunction with a simulator system, to transmit the position of the weapon impact on the target via electromagnetic radiation, for example as coordinates via radio. The last-mentioned case is customary, for example, for simulation of artillery or minefields.

However, there are a number of disadvantages in placing the indicating light on the roof of the tank turret. One disadvantage is that the indicating light is very much unprotected and easily risks being damaged by the branches of trees or the like as the tank advances. There is also a risk of the indicating light being damaged by the crew members who have to climb onto the turret roof in order to get into the tank. In connection with the movements of the crew into and out of the tank via the turret roof, the position of the indicating light can also constitute an obstacle to the crew members who may injure themselves on the light and even stumble and fall off the tank. Another undesired effect of the position of the indicating light on the highest part of the tank is that it protrudes upwards and risks exposing the tank, for example in a situation where the tank is concealed behind a ridge. The first thing which comes into sight in this case is the indicating light. Because the light has a different colour and a particular shape, it is easier to locate the tank at an earlier stage than is the case for a tank without an indicating light. Another disadvantage of a centrally positioned indicating light is that it can be obscured from any direction by objects on the target, for example an opened turret hatch, or by objects between the target and the observer, even though most of the target is visible.

The object of the present invention is to make available a method and an arrangement for indicating hits, which method and arrangement eliminate the disadvantages of the known solutions discussed above.

The object of the invention is achieved by means of a method characterized in that the light source is formed by a plurality of light points which are distributed and mounted along the longitudinal direction of one or more strips which are applied to the target, and an arrangement characterized in that the light source is mounted in at least one strip and is designed with light points for indicating hits distributed along the longitudinal direction of the strip. By arranging the light source in strips and distributing its light points along the strip or strips, an indicating system is obtained which is not based on the roof and which can provide indications all around. This provides for a more protected design without any protruding parts. At the same time, a more integrated design is obtained in which a number of functions have been combined in one site and extra parts in the form of a turret-mounted light can be dispensed with.

According to an advantageous embodiment, the distributed light points of the light source consist of light-emitting diodes. Today's light-emitting diodes have a high degree of reliability and emit light of sufficient strength for the proposed use and are therefore especially suitable. Each one of the distributed light points of the light source advantageously comprises a plurality of light-emitting diodes in a group. In this way, the visibility can be greatly increased since the light from the light-emitting diodes in one group cooperates to form a common light point. A suitable number of light-emitting diodes per group can be 8 to 10.

In another advantageous embodiment, the wavelength of the radiation from the distributed light points can be adapted so that it is clearly perceived by the human eye and/or by sighting systems adapted for other wavelengths, for example IR light.

According to yet another advantageous embodiment, the distributed light points of the light source and the detectors of the simulator system are arranged in common strips. In this case, the light points of the light source can be distributed along the longitudinal direction of the detector strip, alternating with the strip's detectors. This affords a symmetrical design which can be easily applied to the target in the form of, for example, the turret of a tank.

Further advantageous embodiments are set out in the patent claims attached to the description.

The invention will be described in greater detail below with reference to a number of illustrative embodiments.

FIGS. 3*a*–3*d* show schematically four examples of strips with detectors and light points according to the principles of the invention and intended to be applied on a target such as a tank.

Figure 4:
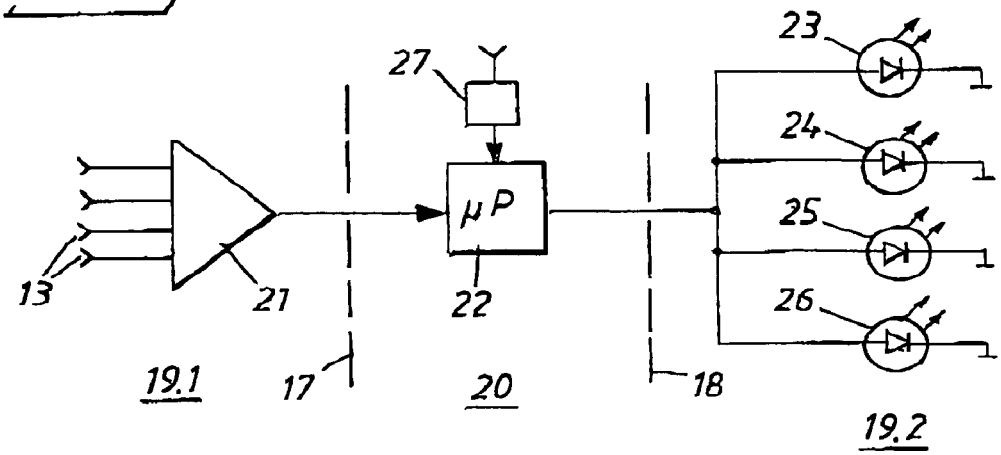

FIG. 4 shows schematically an example of how an arrangement for indicating hits according to the invention can be configured in principle.

Figure 1:
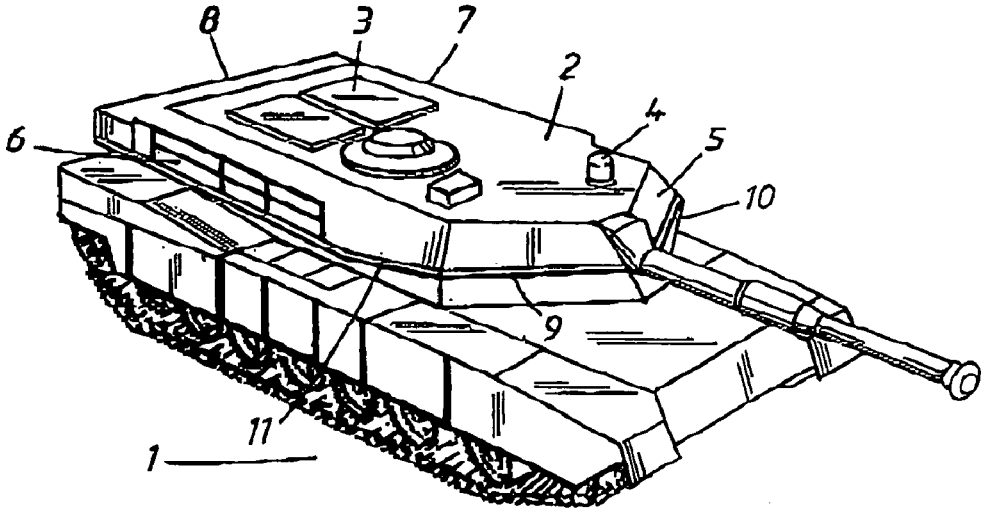
FIG. 1 shows an arrangement of a previously known type for indicating hits, mounted on a tank.

A tank 1 which is equipped with an arrangement for indicating hits is shown in FIG. 1. An indicating light 4 is provided on the roof 2 of the turret 3 of the tank 1. The light can be of the type which has a rotating reflector which rotates around a light source which is fixed in relation to the roof of the turret. Alternatively, the light can be a flashing light. The light shows whether the target in the form of a tank has been hit. By allowing the light to flash for a short time or continuously, it is possible to present two types of hit information.

A number of horizontal strips are arranged on the front 5, sides 6 and 7, and rear 8 of the turret 3, of which strips three can be seen in the figure, namely strips 9 and 10 on the front 5 of the turret and the strip 11 on one side of the turret 3. The strips are provided with a number of detectors (not shown) preferably of the photodiode type. Laser light incident on the detectors is detected by said detectors and triggers activation of the indicating light 4 if the detected signal satisfies the detection criteria which have been set.

The detection criteria can in principle be chosen with a great degree of freedom. The object is to set criteria which to the greatest possible extent filter out interference and at the same time ensure that transmitted hit codes are reliably identified. The problems or disadvantages associated with this arrangement for indicating hits have been dealt with in the introductory part of the description and are therefore not discussed in any detail here.

Figure 2:
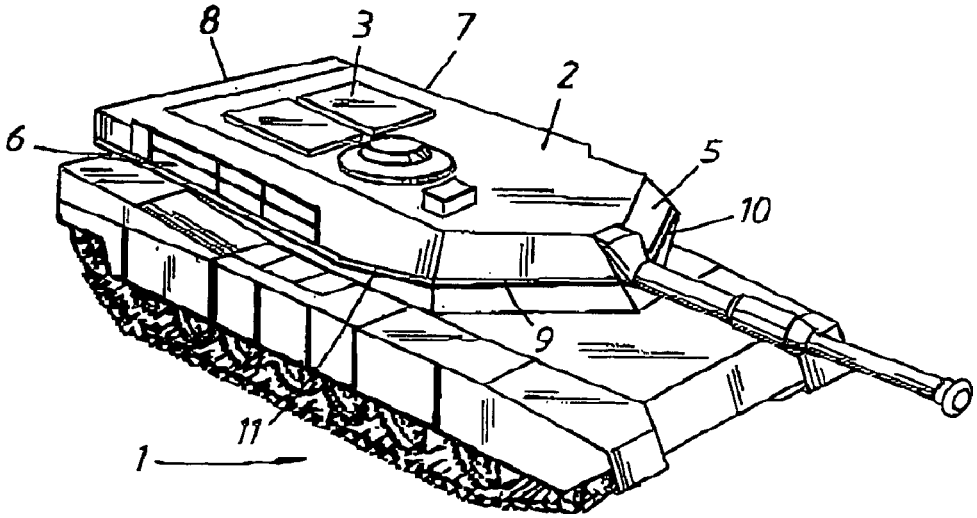
FIG. 2 shows an arrangement according to the invention for indicating hits, mounted on a tank.

The tank 1 according to FIG. 2 is equipped with an arrangement according to the invention for indicating hits. Here, there is no light situated on the roof 2 of the turret 3, and instead the light source has been mounted in the horizontal detector strips, of which 9, 10 and 11 are visible in the figure. In principle, the strips can be arranged in the same way as in the known arrangement according to FIG. 1, with strips secured horizontally on the turret.

FIGS. 3*a*–3*d* show four different examples of detector strips 12 provided with a light source in the form of distributed light points suitable for use in the embodiment shown in FIG. 2. The detectors 13 included are marked in the figure by full circles, while the distributed light points 14 are marked by empty circles in order to readily distinguish between the two types. The light points 14 here consist of one or more light-emitting diodes.

Figure 3A:
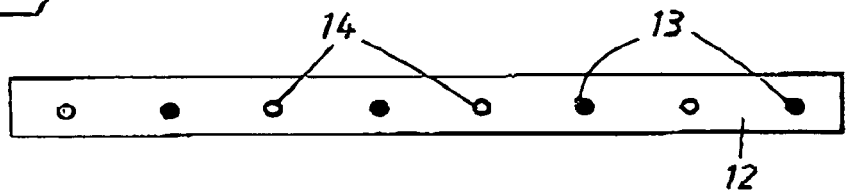

According to the embodiment of the strip shown in FIG. 3*a*, detectors 13 and light-emitting diodes 14 lie alternately along the longitudinal direction of the strip 12. The number of light points required is determined, inter alia, by the light aperture of the used light-emitting diodes.

Figure 3B:
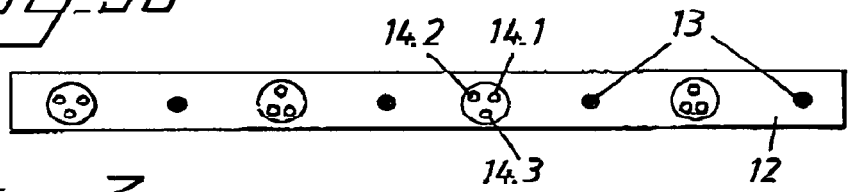

In the embodiment of the strip according to FIG. 3*b*, detectors 13 and light-emitting diodes 14 still alternate. Here, however, each light point has been provided with a plurality of light-emitting diodes 14.1–14.3 in groups, in the case shown here three light-emitting diodes. A higher number of ca. 8–10 may be expedient for obtaining greater light intensity.

Figure 3C:
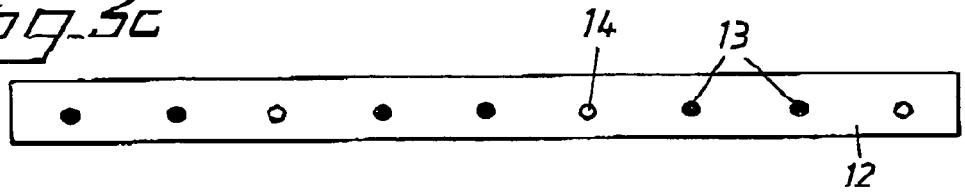

FIG. 3*c* shows a strip embodiment in which the number of light points is fewer than the number of detectors 13. A way of reducing the number of light points in relation to the number of detectors is to use light-emitting diodes with a large light aperture.

Figure 3D:
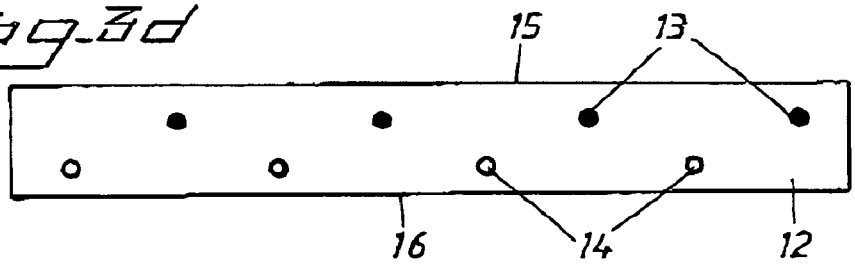

The strip embodiment according to FIG. 3*d* shows a possibility of arranging the detectors 13 offset towards one edge 15 of the strip 12 and of ar ranging the light-emitting diodes 14 offset towards the other edge 16 of the strip 12.

The distribution of detectors and light points or light-emitting diodes along the strip 12 can thus be varied within wide limit and the examples proposed above must not in any way be regarded as limiting in regard to possible variants.

FIG. 4 shows schematically a possible design of the arrangement for indicating hits. Broken lines 17 and 18 mark the interface between the inside of the tank and the strip 12, the left and right parts 19.1 and 19.2 relating to parts of the strip 12, and the central part 20 relating to equipment in the inside of the tank.

Four detectors 13 are in this case arranged in the strip 12. The detectors are coupled to a common amplifier 21. The amplified detector signal is fed to a processor 22, preferably a microprocessor, placed in the tank. On the basis of the received signal and the defined activation criteria, the processor 22 is programmed to determine whether the light points of the light source in the form of light-emitting diodes 23–26 are to be activated in order to indicate hit and, if so, to activate the light-emitting diodes.

In the embodiments described in detail above, it has been assumed as the main solution that the target is equipped with the target part of a simulator system comprising detectors for electromagnetic radiation, preferably laser radiation, and in this case it is an advantage to place the light points in strips together with the detectors. However, the invention is not limited to this case, and instead can also advantageously be used as target indictor in simulator systems where the information on hit positions is transmitted in another way, for example via radio. In such a case, the strips then contain only the distributed light points.

In an extended embodiment, a radio receiver 27 can be connected to the processor 22 in order to receive hit position coordinates, for example for artillery or minefields. This can be done in combination with use of the detectors 13, but designs where all the hit position transmission is done via radio can also be advantageous.

The invention is not limited to the embodiments shown above by way of example, and instead it can be modified within the scope of the attached patent claims.

What is claimed is:

1. A method for indicating hitting of a target object during a military simulation, the method comprising:

arranging a plurality of detectors about a target object, the detectors being operative to detect a simulated strike on the target object;

arranging about the target object in a horizontal direction at least one strip comprising a light source, the light source comprising a plurality of light points distributed along a longitudinal direction of the strip;

analyzing with a processor operatively connected to the detectors and the light source a simulated strike on the target object to determine whether the simulated strike resulted in a simulated hit of the target object; and activating with the processor at least one light point to indicate detection of the simulated hit of the target object.

2. The method according to claim 1, wherein a plurality of strips are arranged on the target.

3. The method according to claim 1, wherein the strip is arranged in a longitudinal direction of the target.

4. The method according to claim 1, wherein the target is a vehicle.

5. The method according to claim 4, wherein the vehicle is a tank, a track-mounted vehicle, a truck or other wheeled vehicle.

6. The method according to claim 1, further comprising:

arranging a plurality of detectors on the at least one strip, the detectors operative to detect incident illuminating electromagnetic radiation;

determining whether detected incident electromagnetic radiation satisfies defined detection criteria; and indicating with the light source when the incident electromagnetic radiation satisfies defined detection criteria.

7. The method according to claim 6, wherein the at least one strip comprises the distributed light points of the light source and the detectors.

8. The method according to claim 1, wherein a hit position is transmitted to the target via electromagnetic radiation in cooperation with a simulator system.

9. The method according to claim 1, wherein light produced by the light source comprises a wavelength or a wavelength range that is adapted so that it is clearly perceived by the human eye.

10. The method according to claim 1, wherein light produced by the light source comprises a wavelength or a wavelength range that is adapted so that it is clearly perceived by sights intended for IR radiation.

11. The method according to claim 1, wherein light produced by the light source comprises at least one of wavelengths or wavelength ranges adapted so that they are clearly perceived both by the human eye and by different types of sights.

12. An arrangement operative to indicate hitting of a target object during a military simulation, the arrangement comprising:

a plurality of detectors arranged about a target object, the detectors being operative to detect a simulated strike on the target object;

at least one strip arranged about the target object in a horizontal direction, the at least one strip comprising a light source, the light source comprising a plurality of light points distributed along a longitudinal direction of the strip, the light source being operative to indicate detection of the simulated hit of the target object; and a processor operatively connected to the detectors and the light source, the processor being operative to analyze a simulated strike on the target object to determine whether the simulated strike resulted in a simulated hit of the target object.

13. The arrangement according to claim 12, wherein arrangement comprises a plurality of strips arranged on the target.

14. The arrangement according to claim 12, wherein the target is a vehicle.

15. The arrangement according to claim 14, wherein the vehicle is a tank, a track-mounted vehicle, a truck or other wheeled vehicle.

16. The arrangement according to claim 12, wherein the distributed light points of the light source comprise light-emitting diodes.

17. The arrangement according to claim 12, wherein each of the distributed light points of the light source comprises a plurality of light-emitting diodes in a group.

18. The arrangement according to claim 17, wherein each group comprises 8 to 10 light-emitting diodes.

19. The arrangement according to claim 12, wherein the detectors are distributed along the at least one strip, and wherein the detectors operative to detect incident illuminating electromagnetic radiation.

20. The arrangement according to claim 19, wherein the detectors and the points of light are alternatingly distributed along the longitudinal direction of the at least one strip.

21. The arrangement according to claim 12, further comprising:

a simulator system operative to transmit a hit position via electromagnetic radiation.

22. A method of conducting a military exercise, the method comprising:

arranging a plurality of detectors about a target object, the detectors being operative to detect a simulated strike on the target object;

arranging about the target object in a horizontal direction at least one strip comprising a light source, the light source comprising a plurality of light points distributed along a longitudinal direction of the strip;

simulating strikes on the target object with electromagnetic energy directed at the target object;

detecting the simulated strikes with the detectors;

analyzing with a processor operatively connected to the detectors and the light source a simulated strike on the target object to determine whether the simulated strike resulted in a simulated hit of the target object; and activating with the processor at least one light point to indicate detection of the simulated hit of the target object.

* * * * *